US007659806B2

(12) United States Patent
Tamaki

(10) Patent No.: US 7,659,806 B2
(45) Date of Patent: Feb. 9, 2010

(54) CHIP RESISTOR AND METHOD OF MAKING THE SAME

(75) Inventor: Yoshikazu Tamaki, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 12/074,254

(22) Filed: Feb. 29, 2008

(65) Prior Publication Data

US 2008/0218306 A1 Sep. 11, 2008

(30) Foreign Application Priority Data

Mar. 2, 2007 (JP) ..... 2007-052491

(51) Int. Cl.
*H01C 1/012* (2006.01)

(52) U.S. Cl. ..... 338/309; 338/307

(58) Field of Classification Search ..... 338/307–309
See application file for complete search history.

(56) References Cited

U.S. PATENT DOCUMENTS 6,166,620 A * 12/2000 Inuzuka et al. ..... 338/309
6,462,304 B2 10/2002 Kaida et al.
6,636,143 B1 * 10/2003 Hashimoto et al. ..... 338/309
7,103,965 B2 * 9/2006 Tanimura ..... 29/610.1
7,221,254 B2 * 5/2007 Tsukada ..... 338/309

FOREIGN PATENT DOCUMENTS

JP 11-40401 2/1999

* cited by examiner

*Primary Examiner*—Kyung Lee
(74) *Attorney, Agent, or Firm*—Hamre, Schumann, Mueller & Larson, P.C.

(57) ABSTRACT

A chip resistor includes an insulating substrate, a pair of electrodes formed on a main surface of the substrate and a resistor element electrically connected to the electrodes. The paired electrodes are spaced from each other in a first direction. The main surface of the substrate is formed with a raised portion in the form of a plateau which is smaller in size than the substrate in a second direction perpendicular to the first direction. The paired electrodes are formed on the raised portion. The resistor element is equal in size to the raised portion in the second direction.

5 Claims, 9 Drawing Sheets

CHIP RESISTOR AND METHOD OF MAKING THE SAME

BACKGROUND OF THE INVENTION

1. Field of the Invention

The present invention relates to a chip resistor and a method of making the same.

2. Description of the Related Art

FIG. 16 shows an example of conventional chip resistor (see JP-A-11-40401). The chip resistor X shown in the figure includes an insulating substrate 91, and a pair of electrodes 92 and a resistor element 93 formed on the substrate. The resistor element 93 includes a slit 93*a* formed by laser trimming to adjust the resistance.

In the above-described structure, the width of the resistor element 93 is smaller at the portion formed with the slit 93*a* than at other portions, so that the resistance is locally high at the slit portion. Thus, when a high voltage is erroneously applied to the chip resistor X, burnout is likely to occur at the narrow portion of the resistor element 93. Thus, the chip resistor X, which has undergone laser trimming, has a drawback that its withstanding voltage is lower as compared with an untrimmed chip resistor.

SUMMARY OF THE INVENTION

The present invention is proposed under the circumstances described above. It is, therefore, an object of the present invention to provide a chip resistor with enhanced withstanding voltage.

According to a first aspect of the present invention, there is provided a chip resistor comprising: an insulating substrate including a main surface; a pair of electrodes formed on the main surface of the substrate and spaced from each other in a first direction; a resistor element formed on the main surface of the substrate and electrically connected to the paired electrodes; and a raised portion in a form of a plateau formed integral with the substrate. The raised portion is smaller in size than the substrate in a second direction perpendicular to the first direction, and the paired electrodes are formed on the raised portion. The resistor element is equal in size to the raised portion in the second direction.

Preferably, the substrate may be formed with a groove dividing the raised portion into two parts spaced from each other in the first direction. The distance between the paired electrodes is equal to the size, of the groove in the first direction.

According to a second aspect of the present invention, there is provided a method of making a chip resistor. The method comprises the steps of: forming a plurality of conductor layers on a main surface of an insulating substrate in a manner such that the conductor layers are spaced from each other in a first direction, and each of the conductor layers is elongated in a second direction perpendicular to the first direction; forming a plurality of resistor layers on the main surface of the insulating substrate in a manner such that each of the resistor layers is elongated in the second direction and covers a region between adjacent two of the conductor layers; and forming a plurality of first grooves in the main surface of the substrate in a manner such that the first grooves are spaced from each other in the second direction, and each of the first grooves is elongated in the first direction.

Preferably, the step of forming a plurality of conductor layers may comprise: forming a plurality of preliminary conductor layers each of which is wider than each of the conductor layers; and forming a plurality of second grooves spaced from each other in the first direction, where each of the second grooves is elongated in the second direction, and has a width larger than the distance between adjacent ones of the preliminary conductor layers.

Other features and advantages of the present invention will become more apparent from the detailed description given below with reference to the accompanying drawings.

DETAILED DESCRIPTION OF THE PREFERRED EMBODIMENTS

Preferred embodiments of the present invention will be described below with reference to the accompanying drawings.

FIGS. 1-4 show an example of chip resistor according to the present invention. The illustrated chip resistor A includes a substrate 1, a pair of electrodes 2, a resistor element 3 and a protective layer 4.

Figure 4:
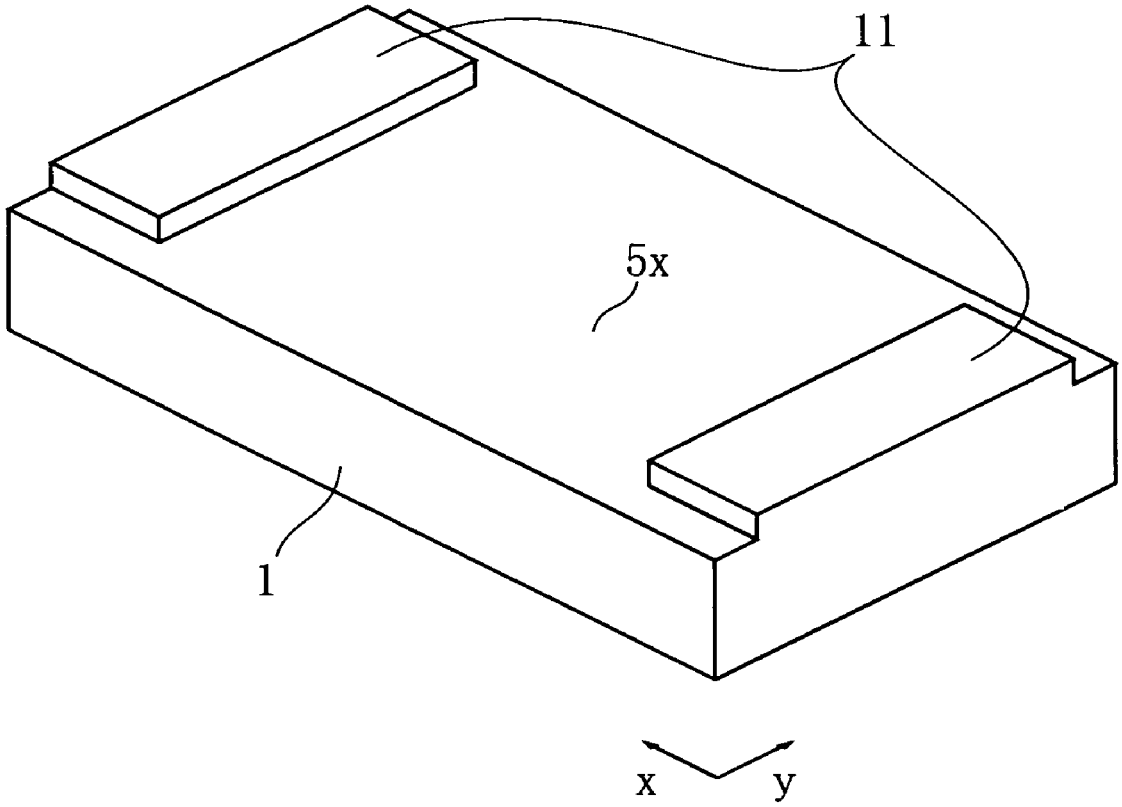
FIG. 4 is a perspective view showing the substrate of the chip resistor of FIG. 1.

The substrate 1 is generally rectangular and made of an insulating material such as $Al_2O_3$. FIG. 4 is a perspective view showing the substrate 1 only. The substrate 1 includes a flat main surface (the upper surface in the figure) and two raised portions 11 in the form of a plateau formed on the main surface. Each of the raised portions 11 includes a rectangular upper surface extending in parallel with the main surface of the substrate 1. The raised portion 11 has a predetermined height from the main surface of the substrate 1 in the thickness direction of the substrate 1. The two raised portions 11 are spaced from each other in the x direction, with a groove 5*x* intervening between the raised portions. The groove 5*x* extends in the y direction with a constant width and is rectangular in cross section. Each of the raised portions 11 is located at the center of the substrate 1 in the y direction, and the dimension of the raised portion 11 measured in the y direction is constant. For instance, the substrate 1 has a size of about 1.0 mm×0.5 mm as viewed in plan and a thickness of about 0.3 to 0.4 mm. The height of the raised portions 11 is about 0.05 mm.

Figure 1:
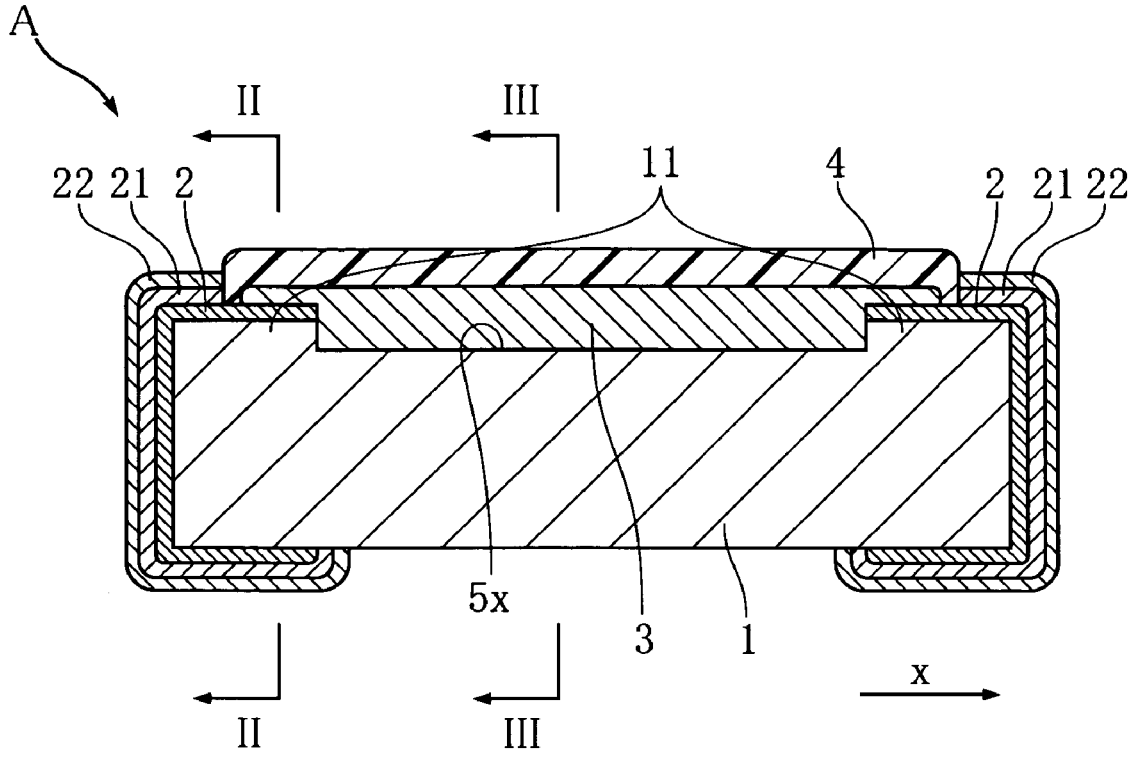
FIG. 1 is a sectional view showing an example of chip resistor according to the present invention.
Figure 2:
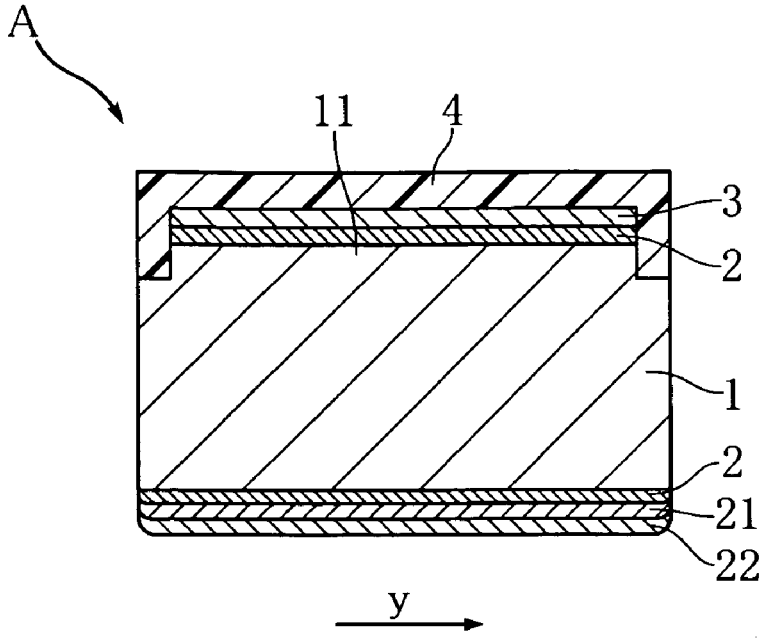
FIG. 2 is a sectional view taken along lines II-II in FIG. 1.

The electrodes 2 are made of a conductor such as Ag. As shown in FIGS. 1 and 2, part of each electrode 2 directly covers the upper surface of a corresponding one of the raised portions 11. The portion of the electrode 2 which covers the raised portion 11 has the same shape as that of the raised portion 11 as viewed in plan. Each of the electrodes 2 extends on an end surface (side surface oriented in the x direction) of the substrate 1 up to an end of the reverse surface of the substrate. In this embodiment, plating layers 21 and 22 are formed on each of the electrodes 2. The plating layer 21 may be made of e.g. Ni, whereas the plating layer 22 may be made of e.g. Sn.

The resistor element 3 is made of a resistive material such as ruthenium oxide. As shown in FIG. 1, each end of the resistor element 3, covers an end of the corresponding electrode 2. The groove 5*x* is filled with the resistor element 3. As shown in FIG. 2, the dimension of the resistor element 3 in the y direction is equal to that of the raised portions 11 and the electrode 2. As will be understood from FIGS. 2 and 3, the dimension of the resistor element 3 in the y direction is constant. Of the resistor element 3, the portion intervening between the two electrodes 2 (i.e., the portion intervening between the two raised portions 11) functions to determine the resistance of the chip resistor A.

Figure 3:
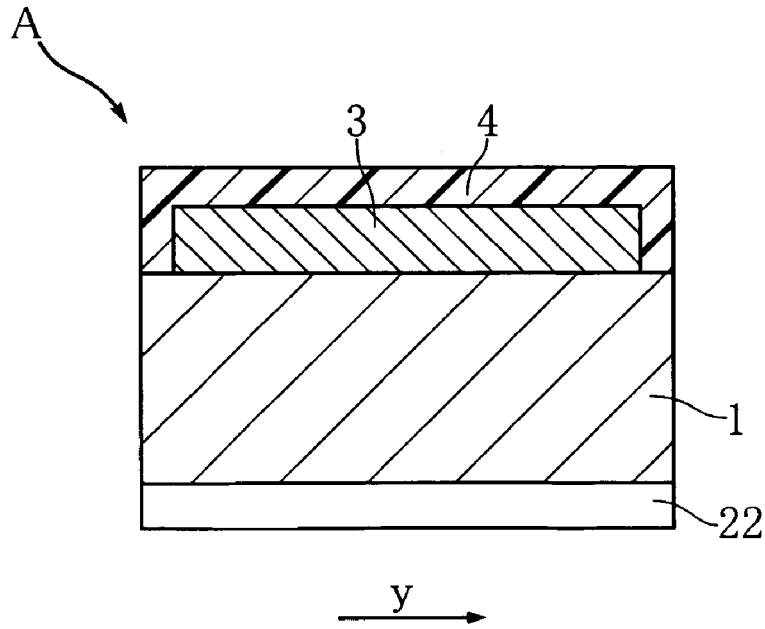
FIG. 3 is a sectional view taken along lines III-III in FIG. 1.

The protective layer 4 covers the resistor element 3 and part of each electrode 2, and is made of e.g. glass. As shown in FIGS. 2 and 3, the protective layer 4 extends throughout the entire width of the substrate 1 in the y direction.

A method of making a chip resistor A will be described below with reference to FIGS. 5-15. By this manufacturing method, a plurality of chip resistors A are made collectively.

Figure 5:
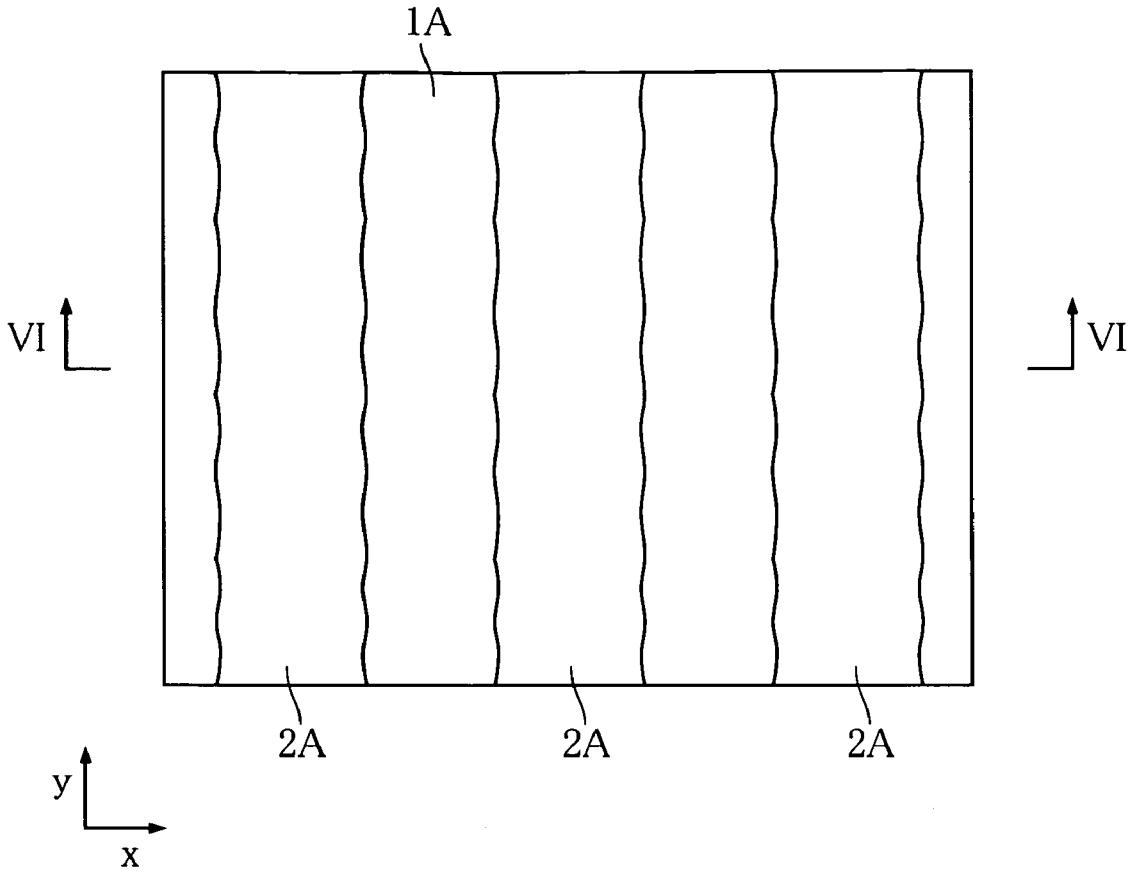
FIG. 5 is a plan view of a principal portion showing the step of forming a conductor layer in a method of manufacturing a chip resistor according to the present invention.
Figure 6:
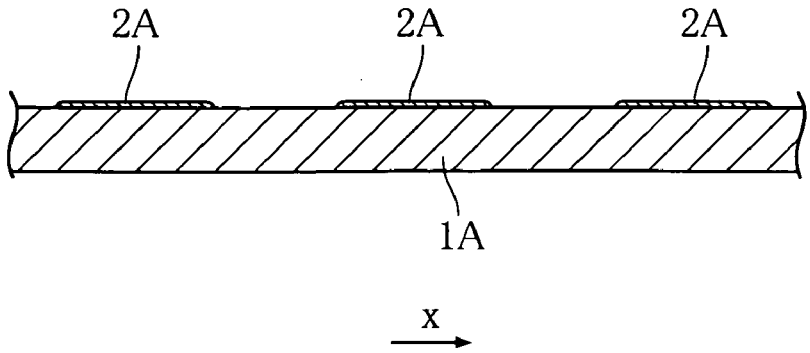
FIG. 6 is a sectional view taken along lines VI-VI in FIG. 5.

First, as shown in FIGS. 5 and 6, a substrate 1A made of an insulating material such as $Al_2O_3$ is prepared. The substrate 1A has a size capable of providing a plurality of substrates 1 of chip resistors A and may have a thickness of about 0.3 to 0.4 mm. A plurality of conductor layers (preliminary conductor layers) 2A, which are the strips extending in the y direction, are formed on the upper surface of the substrate 1A by printing a conductor paste containing a conductor such as Ag, for example.

Figure 7:
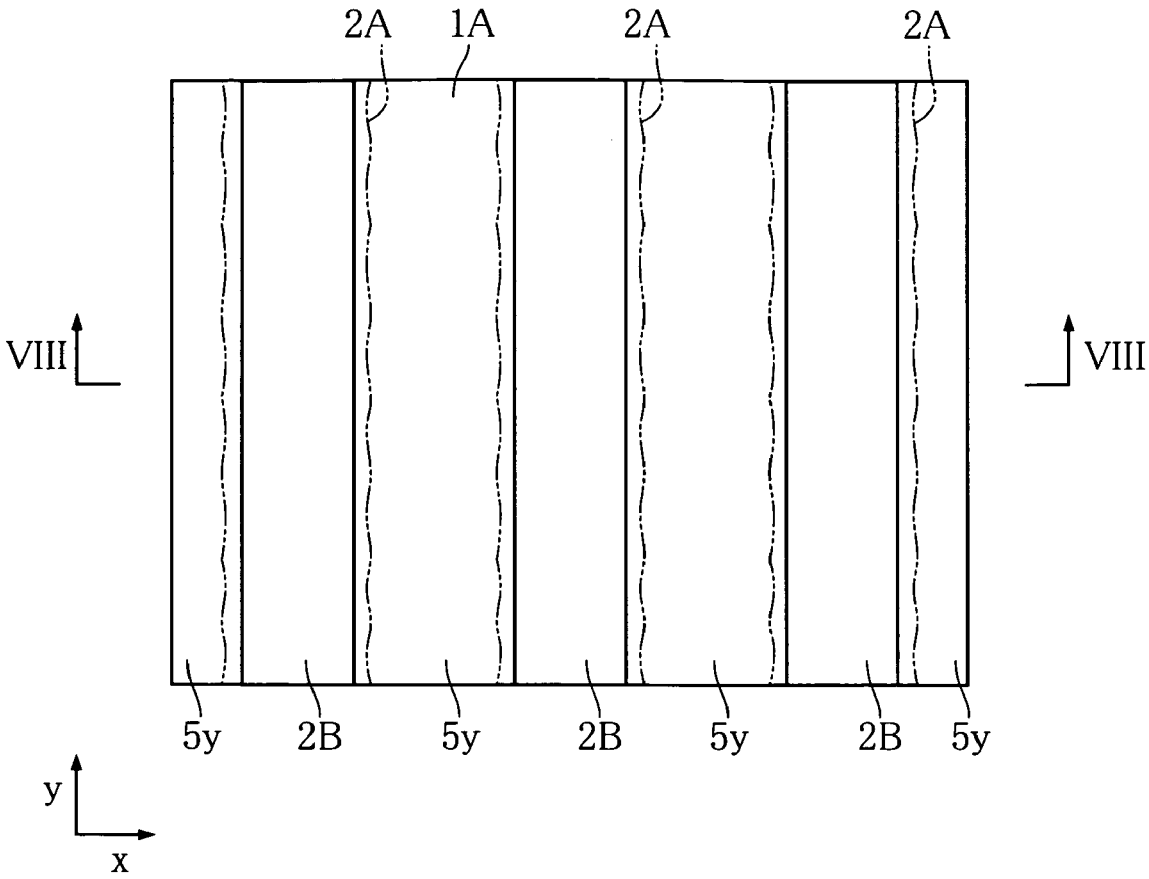
FIG. 7 is a plan view of a principal portion showing the step of forming grooves in the manufacturing method according to the present invention.
Figure 8:
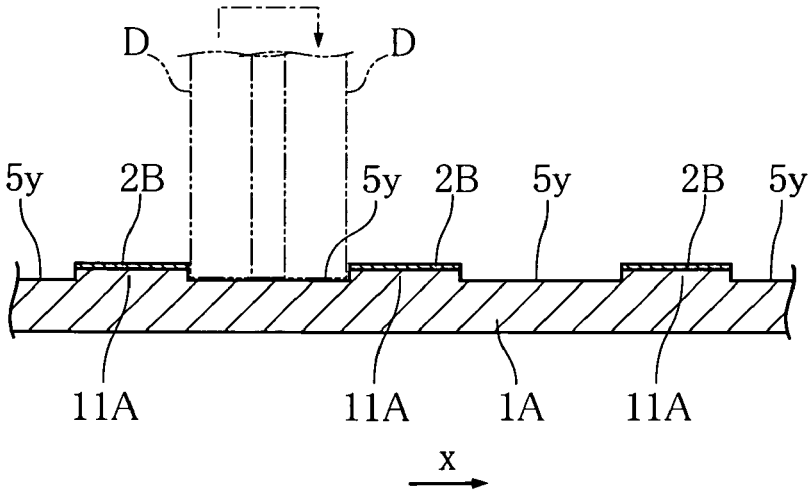
FIG. 8 is a sectional view of a principal portion taken along lines VIII-VIII in FIG. 7.

Then, as shown in FIGS. 7 and 8; a plurality of grooves 5*y* are formed. Each of the grooves 5*y* is formed by cutting part of the substrate 1A into a depth of about 0.05 mm by moving a rotating dicing blade D in the y direction. As a result, a raised portion 11A in the form of a strip is formed between adjacent ones of the grooves 5*y* of the substrate 1. In forming each groove, the dicing blade D is placed to partially overlap an edge of the conductive layer 2A. Thus, part of the conductor layer 2A is removed together with part of the substrate 1A by the dicing blade D. In this embodiment, as the dicing blade D, use is made of one having a thickness which is smaller than that of the grooves 5*y* to be formed. After once being moved in the y direction, the dicing blade D is shifted in the x direction by a predetermined distance so that part of the dicing blade D overlaps an edge of the conductor layer 2A located on the near side in the shift direction. In this state, the dicing blade D is again moved in the y direction. In this way, a single groove 5*y* is formed. The width, i.e., the dimension in the x direction of each groove 5*y* is larger than the distance between adjacent conductor layers 2A (see FIG. 5). By repetitively performing the movement and shift of the dicing blade D at predetermined intervals in the x direction, a plurality of grooves 5*y* spaced from each other by a predetermined distance in the x direction are formed. By reducing the width in the above-described manner, the conductor layers 2A become conductor layers 2B.

The adjustment of the shifting amount of the dicing blade D will be described below. The width of the groove 5*y* is a dimension of the portion of the resistor element 3 which determines the resistance of the chip resistor A. The width of the groove 5*y* is determined by the thickness of the dicing blade D and the shifting amount. To make the resistance of the chip resistor A lie within the allowable error margin of the rated resistance, the groove 5*y* needs to have a predetermined width. To achieve this, for instance, provisional grooves 5*y* are formed using the dicing blade D. Then, the width of each provisional groove 5*y* is measured to grasp the dimensional error of the width of the groove 5*y*. Based on this measurement, the shifting amount of the dicing blade D with respect to each groove is adjusted to eliminate the dimensional error. In this way, the manufacturing process of the chip resistor A, including formation of the desired grooves 5*y* is performed. The adjustment of the shifting amount ensures that the resulting grooves 5*y* have a required width.

Figure 9:
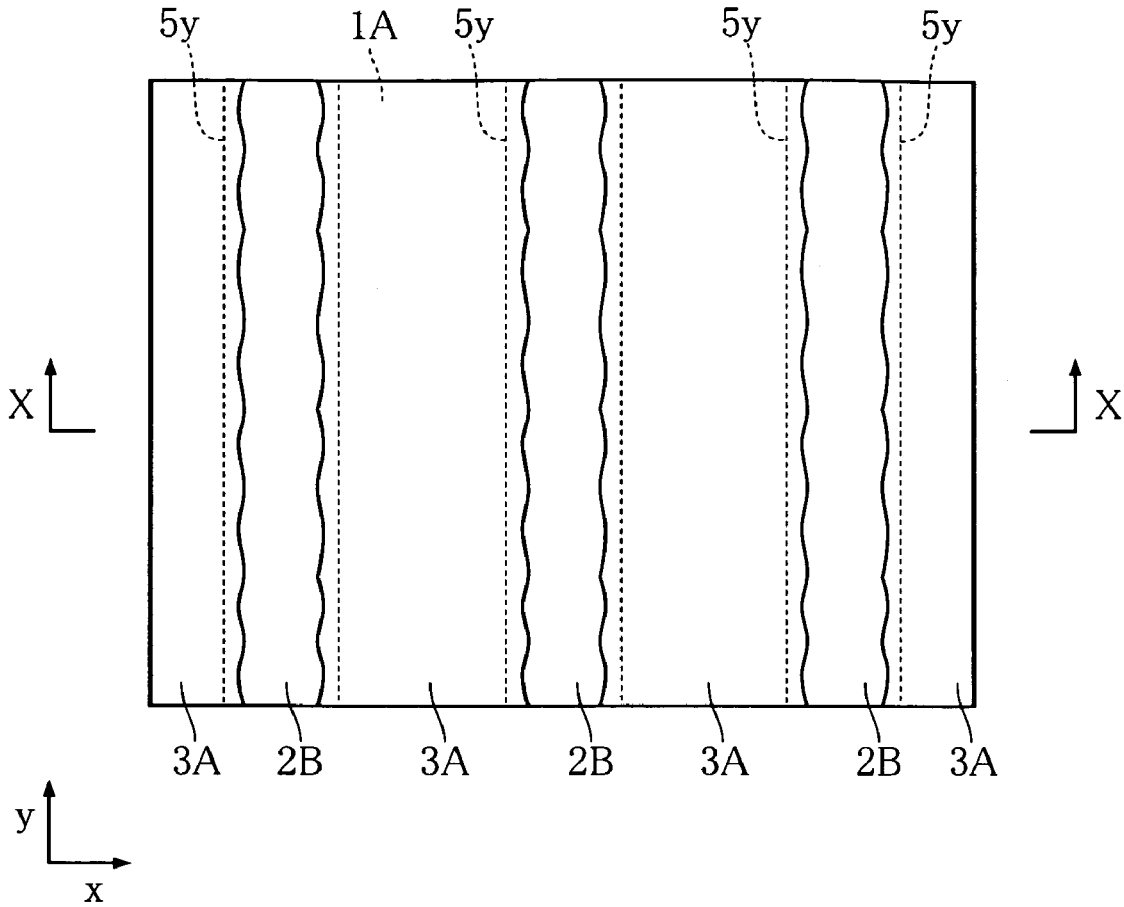
FIG. 9 is a plan view of a principal portion showing the step of forming a resistor layer in the manufacturing method according to the present invention.
Figure 10:
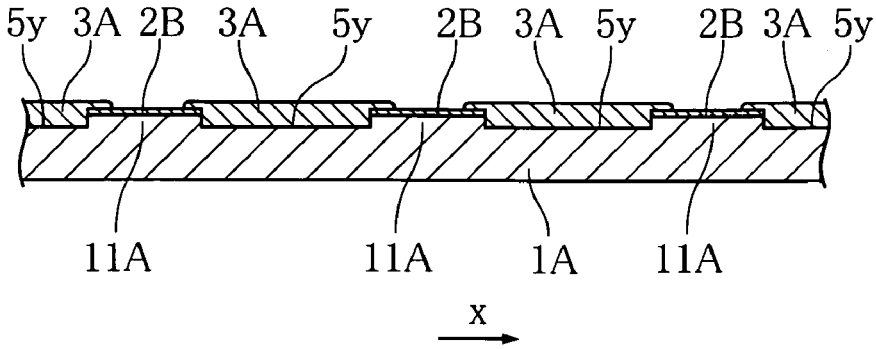
FIG. 10 is a sectional view of a principal portion taken along lines X-X in FIG. 9.

Then, as shown in FIGS. 9 and 10, a plurality of resistor layers 3A are formed. The resistor layers 3A are formed by printing a resistor paste containing a resistive material such as ruthenium oxide. In the printing process, the resistor paste is applied into the form of strips which fill the grooves 5*y* and each of which overlaps the adjacent conductor layers 2B at the edges thereof. The resistor layers 3A formed in this way extend in parallel with each other, arranged at regular intervals in the x direction and have a width which is larger than that of the grooves 5*y*.

Figure 11:
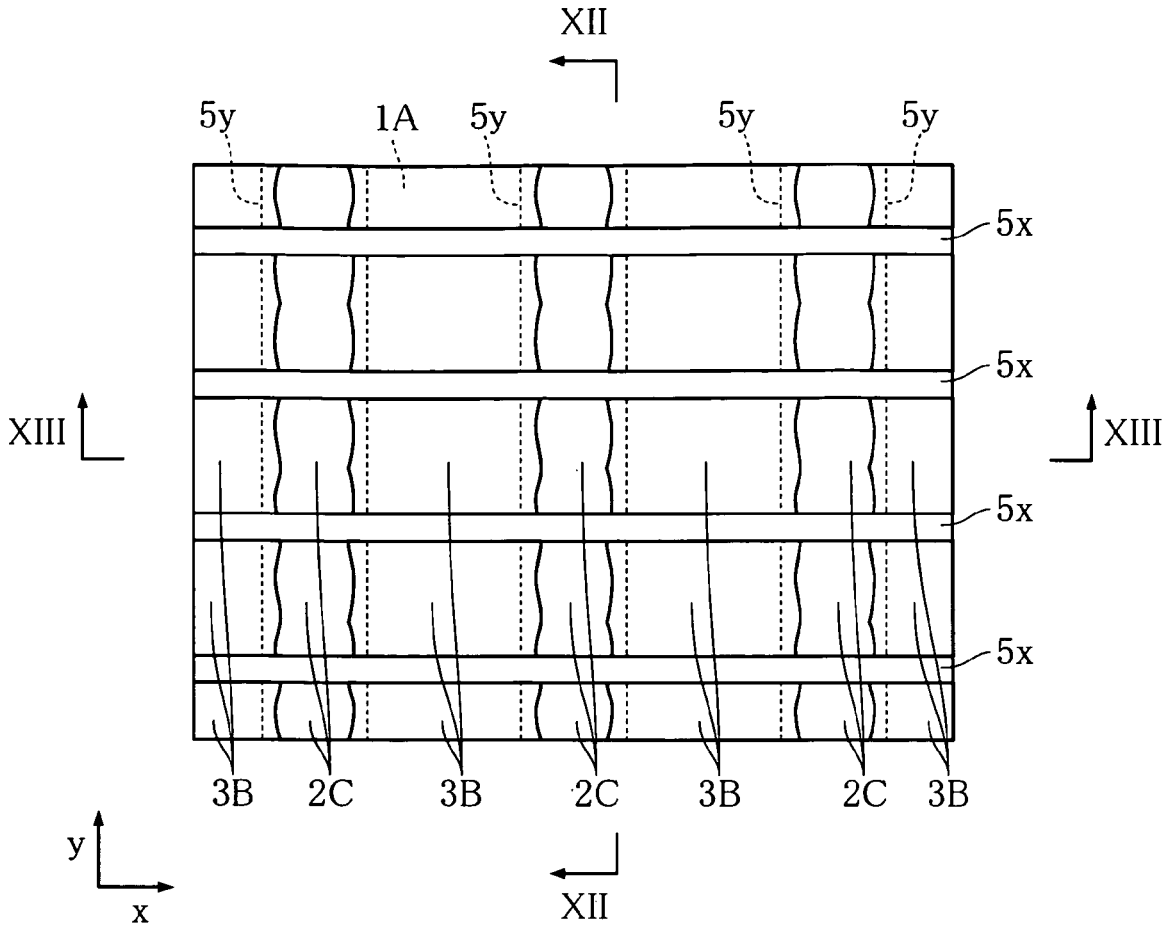
FIG. 11 is a plan view of a principal portion showing the step of forming grooves in the manufacturing method according to the present invention.
Figure 12:
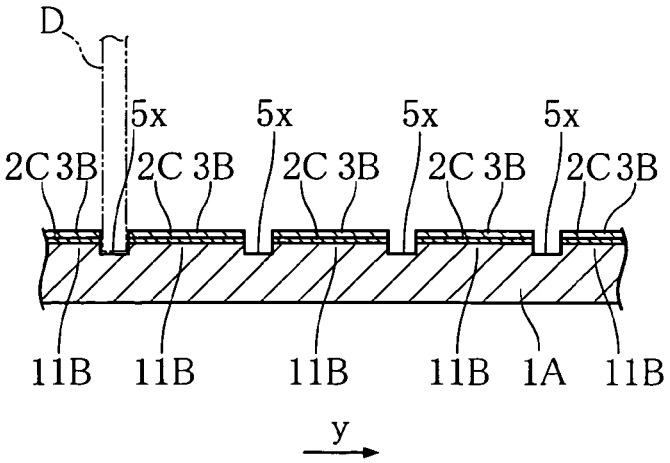
FIG. 12 is a sectional view of a principal portion taken along lines XII-XII in FIG. 11.
Figure 13:
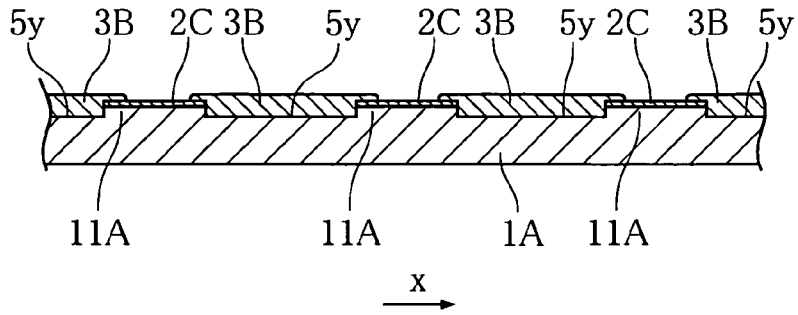
FIG. 13 is a sectional view of a principal portion taken along lines XIII-XIII in FIG. 11.

Then, as shown in FIGS. 11-13, a plurality of grooves 5*x* are formed by dicing. In the dicing process, a dicing blade D is moved in the x direction to grind part of the substrate 1A into a depth of e.g. about 0.05 mm. In this process, the dicing blade D moves across the conductor layers 2B, the resistor layers 3A and the raised portions 11A shown in FIGS. 9 and 10. As a result, each of the conductor layers 2B is divided into a plurality of conductor layers 2C, whereas each of the resistor layers 3A is divided into a plurality of resistor layers 3B, as shown in FIGS. 11-13. Each of the raised portions 11A is divided into a plurality of raised portions 11B. The dimension of the conductor layer 2C and resistor layer 3B in the y direction is equal to the distance between adjacent grooves 5*x*.

Figure 14:
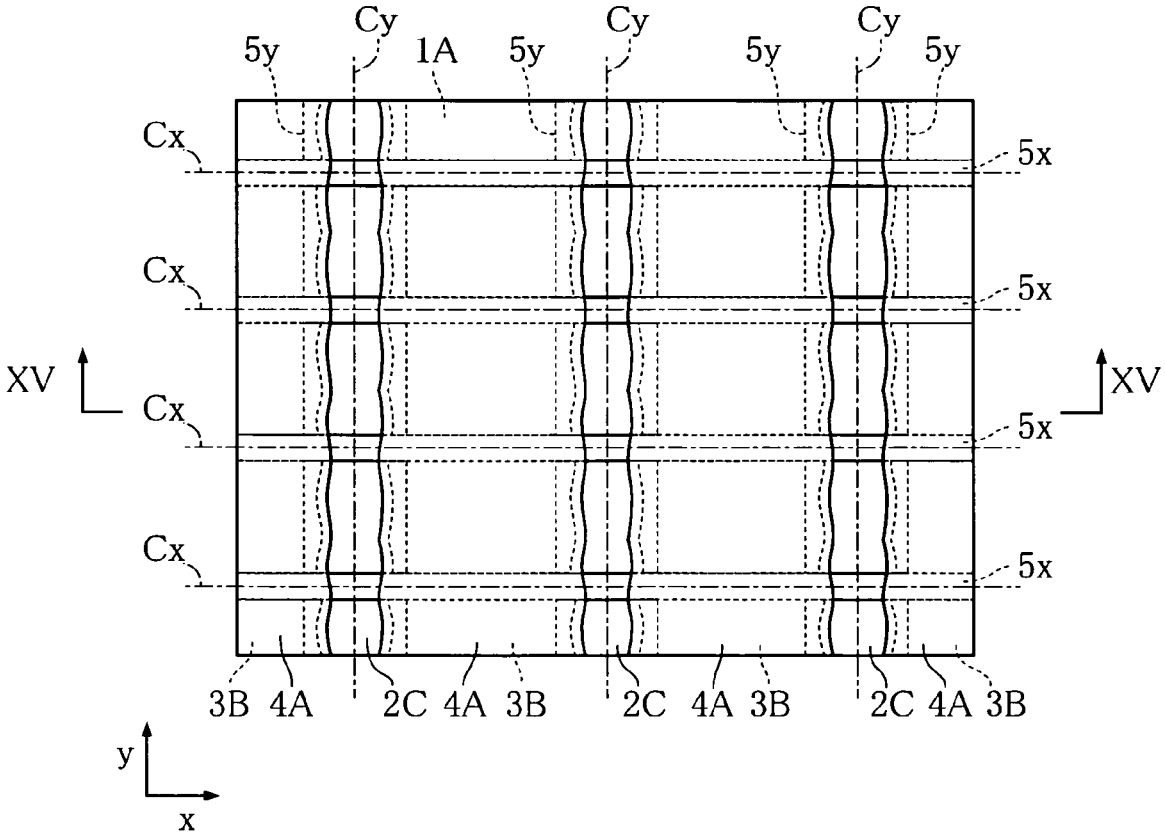
FIG. 14 is a plan view of a principal portion showing the step of forming an insulating layer in the manufacturing method according to the present invention.
Figure 15:
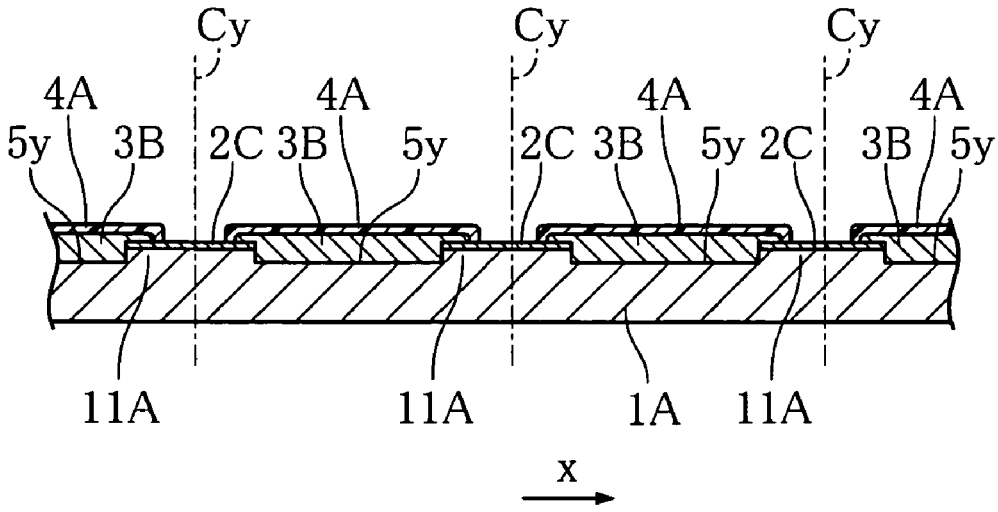
FIG. 15 is a sectional view of a principal portion taken along lines XV-XV in FIG. 14.
Figure 16:
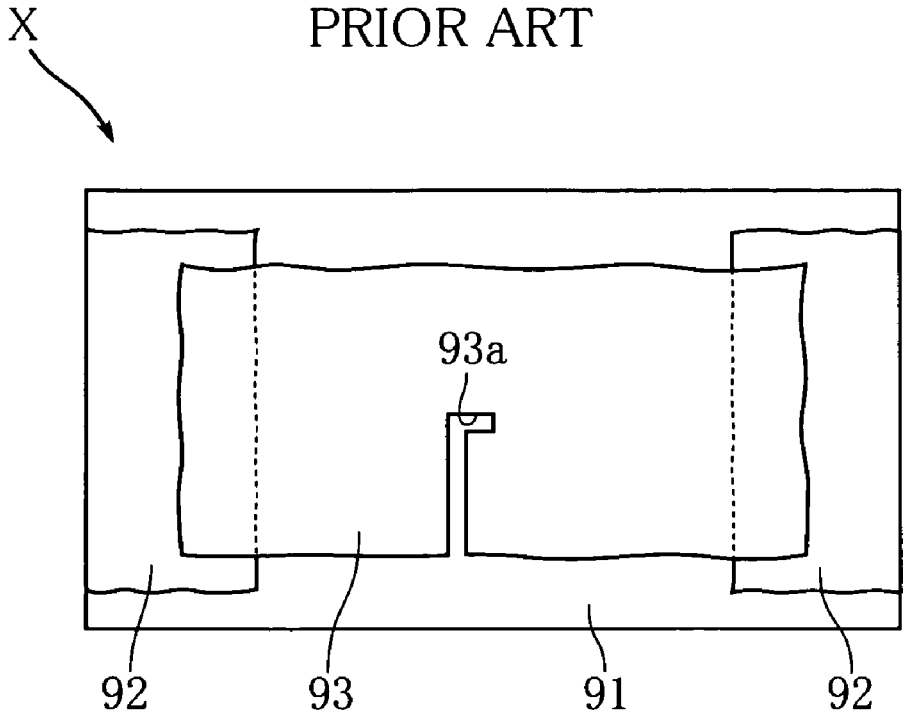
FIG. 16 PRIOR ART
FIG. 16 is a sectional view showing an example of conventional chip resistor.

Then, as shown in FIGS. 14 and 15, a plurality of insulating layers 4A are formed. The insulating layers 4A are formed by printing an insulating paste containing an insulating material such as glass. In this process, the insulating paste is applied into the form of strips arranged at the same pitch as that of the resistor layers 3B and each having a dimension in the x direction which is slightly larger than that of the resistor layers 3B. Each of the insulating layers 4A formed in this way covers a respective one of the resistor layers 3B and part of the adjacent conductor layers 2C.

Then, the substrate 1A is cut along the cutting lines Cy. The cutting lines Cy generally correspond to the center of the conductor layers 2C in the x direction. The cutting may be performed by dicing. Alternatively, a plurality of grooves (not shown) corresponding to the cutting lines Cy may be formed in the substrate 1A in advance, and the substrate 1A may be cut by bending using the grooves. By the cutting, the substrate 1A is divided into bars. By plating the bar-shaped substrate 1A with Ag, for example, the conductor layer 2C is expanded onto the end surface in the x direction and reverse surface of the substrate 1A. Then, by performing Ni-plating and Sn-plating, a Ni-plating layer and a Sn-plating layer covering the expanded conductor layer 2*c* are formed. Then, the bar-shaped substrate 1A is cut along the cutting lines Cx. The cutting lines Cx generally correspond to the center of grooves 5*x*. The cutting may be performed by dicing. Alternatively, a plurality of grooves (not shown) corresponding to the cutting lines Cx may be formed in the substrate 1A in advance, and the substrate 1A may be cut by bending using the grooves. By the cutting, the bar-shaped substrate 1A is divided into a plurality of substrates 1 shown in FIGS. 1-4. In this way, the chip resistor A shown in FIGS. 1-3 is obtained.

The technical advantages of the chip resistor A and the manufacturing method will be described below.

According to this embodiment, the resistor element reliably has a desired dimension in the y direction. Specifically, as described with reference to FIGS. 11 and 12, the resistor layer 3B is formed by dividing the resistor layer 3A with the dicing blade D in the process of forming the grooves 5*x*. Unlike the formation of a resistor layer by printing only, the formation of the resistor layer 3B in the above-described manner ensures that the resistor layer formed has a desired dimension in the y direction with high accuracy. Further, since the resistor layer 3A is originally a strip extending in the y direction, the thickness of the resistor layer is constant in the y direction except at portions adjacent to the ends. Accordingly, the thickness of the resistor element 3 is substantially constant in the y direction. Since the resistor element 3 has the desired dimension in the y direction and constant thickness, error in resistance of the chip resistor A is reduced.

Moreover, a desired distance is defined precisely between a pair of electrodes. Specifically, as shown in FIGS. 5 and 6, since the conductor layers 2A are formed by printing, the position of the conductor layers 2A cannot help being slightly deviated from the desired position due to e.g. protrusion of the conductor paste. On the other hand, the conductor layers 2B shown in FIGS. 7 and 8 are formed by cutting off part of the conductor layers 2A with the dicing blade D in the process of forming the grooves 5*y*. Thus, a desired distance, which is equal to the dimension of the groove 5*y*, is precisely defined between adjacent conductor layers 2B. Thus, a desired distance is precisely defined between the paired electrodes 2. As a result, the dimension in the x direction of the portion of the resistor element 3 which intervenes between the electrodes 2, i.e., the portion which determines the resistance is made precisely equal to the predetermined value, whereby error in resistance of the chip resistor A is reduced.

Particularly, as described with reference to FIG. 8, the dicing blade D is moved in the y direction a plurality of times to form a single groove 5*y*. Thus, the two edges of the groove 5*y* correspond to the lines along which the end surfaces (the right end the left end surfaces) of the dicing blade D has moved in the first and the last cutting process. With this technique utilizing the end surfaces of the dicing blade D, the accuracy of positioning in the x direction is considerably enhanced as compared with the formation by printing only.

With the above-described chip resistor A, the error in resistance is reduced to not more than several percent, for example. Such error in resistance is considerably lower than the error involved when the resistor layer is formed only by the conventional printing, which sometimes exceeds 10 percent. According to the present invention, therefore, the laser trimming process, which has been conventionally employed, can be omitted. Thus, a slit, which causes a local increase in resistance of the resistor element 3, is not formed, whereby the withstanding voltage of the chip resistor A is enhanced.

The chip resistor and the manufacturing method according to the present invention are not limited to the foregoing embodiments. The specific structure of the chip resistor and the manufacturing method according to the present invention may be varied in design in many ways. For instance, in the foregoing embodiment, the groves 5*y* are formed using a dicing blade D whose thickness is smaller than the width of the grooves 5*y*. Instead, however, use may be made of a dicing blade whose thickness is equal to the width of the groove 5*y*.

The invention claimed is:

1. A chip resistor comprising:

an insulating substrate including a main surface;

a pair of electrodes formed on the main surface of the substrate and spaced from each other in a first direction, each of the electrodes having an inner edge;

a resistor element formed on the main surface of the substrate and electrically connected to the paired electrodes; and a pair of raised portions each in a form of a plateau formed integral with the substrate, each of the raised portions having an inner edge;

wherein each of the raised portions is smaller in size than the substrate in a second direction perpendicular to the first direction and parallel to the main surface of the substrate, each of the paired electrodes being formed on a respective one of the raised portions, the resistor element being equal in size to the raised portion in the second direction, the inner edge of each electrode being flush with the inner edge of the corresponding raised portion.

2. The chip resistor according to claim 1, wherein the resistor element includes portions overlapping the raised portions above the electrodes.

3. A method of making a chip resistor, the method comprising:

forming a plurality of conductor layers over a plurality of raised portions, respectively, on a main surface of an insulating substrate, the conductor layers being spaced from each other in a first direction, each of the conductor layers being elongated in a second direction perpendicular to the first direction and parallel to the main surface of the substrate, each of the conductor layers having a pair of edges, each of the raised portions also having a corresponding pair of edges that are flush with the corresponding conductor layer;

forming a plurality of resistor layers on the main surface of the insulating substrate, each of the resistor layers being elongated in the second direction and covering a region between adjacent two of the conductor layers; and forming a plurality of first grooves in the main surface of the substrate, the first grooves being spaced from each other in the second direction, each of the first grooves being elongated in the first direction.

4. The method according to claim 3, wherein the formation of the plurality of conductor layers comprises:

forming a plurality of preliminary conductor layers each of which is wider than each of the conductor layers; and forming a plurality of second grooves spaced from each other in the first direction by partially cutting the preliminary conductor layers and the main surface of the substrate, each of the second grooves being elongated in the second direction, each of the second grooves having a width larger than distance between adjacent ones of the preliminary conductor layers.

5. The method according to claim 3, wherein the formation of the resistor layers is performed in a manner such that the resistor layers partially overlap the raised portions above the conductor layers.

* * * * *